United States Patent [19]

Dechelette

[11] 3,932,017

[45] Jan. 13, 1976

[54] ELECTRICAL TERMINAL ASSEMBLY AND TERMINAL THEREFOR

[75] Inventor: Helen Dechelette, Saint Cloud, France

[73] Assignee: AMP Incorporated, Harrisburg, Pa.

[22] Filed: May 15, 1974

[21] Appl. No.: 469,998

[30] Foreign Application Priority Data

May 30, 1973 France ..... 73.19918

[52] U.S. Cl. ..... 339/97 P; 339/276 A

[51] Int. Cl.[2] ..... H01R 13/32

[58] Field of Search ..... 339/95, 97–99, 339/256, 258, 276 A, 17; 317/101 C; 174/88 R; 338/322

[56] References Cited

UNITED STATES PATENTS

| | | | |
|---|---|---|---|
| 2,947,965 | 8/1960 | Scoville | 339/95 D |
| 3,403,372 | 9/1968 | Stinson, Jr. | 339/97 R |
| 3,617,983 | 11/1971 | Patton | 339/98 |
| 3,622,950 | 11/1971 | Millinger | 339/258 R |
| 3,805,214 | 4/1974 | Demler, Sr. et al. | 339/17 R |

*Primary Examiner*—Joseph H. McGlynn

*Attorney, Agent, or Firm*—William J. Keating; Jay L. Seitchik; Frederick W. Raring

[57] ABSTRACT

In an electrical component support assembly the lead wires (which are of different gauges) of electrical components, e.g. resistors, are each griped by the walls of two slots of identical slotted plate terminals. The slots nearest the components have a minimum width greater than that of the slots farther from the components so that the smaller gauge lead wires are securely gripped by the slot walls of the farther slots but the larger lead wires are not sheared through by the walls of the slots nearer the components to an extent to impair the support of the components.

1 Claim, 3 Drawing Figures

ELECTRICAL TERMINAL ASSEMBLY AND TERMINAL THEREFOR

This invention relates to an electrical terminal assembly and a terminal which is suitable for use in such assembly.

There is disclosed in U.S. Pat. No. 2,762,030, an electrical terminal assembly for the connection of electrical circuit components, for example, resistors, which have a lead wire projecting from each end, to external leads and for supporting such components on a panel, the assembly comprising a plurality of electrical terminals which are secured to the panel and which have lead wire receiving slots into which the end portions of the lead wires of the components have been forced at right-angles to the longitudinal axes of such end portions, electrically to connect the lead wires to the terminals.

In such an assembly the lead wire receiving slots of the terminals must be sized broadly in accordance with the gauge of the lead wires. Thus where the components and thus their lead wires are of substantially different sizes it is necessary to use in the assembly terminals having differently sized slots. Not only therefore must the maker of such assemblies keep a stock of different terminals, but the terminals must be distributed on the panel in such a way that the slot sizes of the terminals coincide with particular components to be supported. The present invention is intended for the avoidance of these disadvangtages.

According to one aspect of the invention, an electrical terminal assembly for the connection of electrical circuit components, for example resistors, which have a lead wire projecting from each end, to external leads and for supporting such components on a panel, comprises a plurality of electrical terminals which are secured to the panel and which have lead wire receiving slots into which the end portions of the lead wires of the components have been forced at right-angles to the longitudinal axes of such end portions, electrically to connect the lead wires to the terminals, in which assembly the lead wires are not all of the same gauge, each terminal comprising a pair of substantially parallel plates arranged in face-to-face realtionship, each such plate having a wire receiving slot, the terminals being arranged on the panel in two opposed rows, with the plates of all the terminals in substantially parallel relationship, each terminal of one row being arranged opposite to a terminal of the other row, both the slots of one terminal of each pair of opposite terminals receiving the end portion of one lead wire of each component and both the slots of the other terminal of the pair receiving the end portion of the other lead wire of the same component, so that the terminals of the pair cooperate to support the component, at least one slot of each terminal serving tightly to grip the wire end portion, that slot of each terminal, which slot is nearest the electrical component, having a minimum width which is not less than the diameter of the smallest gauge lead wire.

Since the slot nearest the electrical component is at least as wide as the smallest diameter lead wire the walls of this slot will not shear through any of the lead wires to such an extent, between the body of the component and the plate nearest the component, as to destroy the effective support of the component. It is thus of no disadvantage if the slots of the plates which are farthest from the components are made narrow enough to grip the smallest gauge wires, and so narrow enough substantially to sever the larger gauge lead wires. By virtue of the invention a single standard sized terminal can be used for supporting all the components.

According to another aspect of the invention, an electrical terminal assembly for the connection of electrical circuit components to external leads and for supporting the components on a panel, comprises a plurality of electrical terminals which are secured to the panel and which have lead wire receiving slots into which lead wires of the components have been forced, electrically to connect the lead wires to the terminals, the terminals also having lead connecting means to which the external leads are connected; wherein each terminal has a pair of oppositely disposed lead wire receiving slots, one of these slots being of greater width than the other, the terminals being arranged on the panel in two opposed rows, so that the slots of each terminal of one row are at least substantially in alignment with the slots of the terminals of the other row, the wider slot of each terminal of one row facing the wider slot of a terminal of the other row, each pair of aligned terminals cooperating to support one of the components, the lead wires of which components need not be all of the same gauge.

According to a further aspect of the invention, an electrical terminal comprises a base in the form of a flat plate, a lug projecting from one edge of the plate, an external lead connecting post projecting from the opposite edge of the plate and an electrical component supporting and connecting member also projecting from the opposite edge of the plate, the connecting member comprising a pair of parallel plates connected by a bight of the terminal material, the bight having a lead wire guiding mouth communicating with a lead wire receiving slot in each of the parallel plates, the slot of one of the parallel plates being narrower than the slot of the other parallel plate, the other parallel plate being directly connected to the opposite edge of the base plate and being coplanar therewith, the post being coplanar with the other parallel plate, the one parallel plate being connected by a bight to a wire severing plate parallel thereto and having a wire severing edge extending across the slot of the one parallel plate.

For a better understanding of the invention, reference will now be made by way of example to the accompanying drawings, in which.

Figure 3:
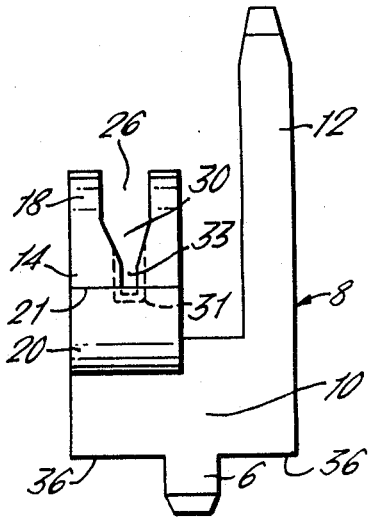
FIG. 3 is a front elevational view of an electrical terminal of the assembly.

An insulating panel 2 has two rows of holes 4 in which are force-fitted lugs 6 of identical electrical terminals 8. Each terminal comprises a flat base 10 from the lower (as best seen in FIG. 3) edge of which the lug 6 of the terminal extends. From the opposite edge of the base 10 of each terminal there extends a wire connecting post 12 and an electrical component supporting and connecting member 14, in juxtaposed relationship. Each terminal 8 was made by stamping and forming a single piece of sheet metal stock, for example brass stock. The member 14, which is substantially S-shaped as seen in side elevation, comprises three parallel plates 16, 18 and 20, respectively, which are connected to one another by smoothly rounded bights 22 and 24, the bight 22 connecting the plates 16 and 18 and the bight 24 connecting the plates 18 and 20. The plate 16 extends directly from the upper (as seen in Figures) edge of the base 10.

The bight 22 is formed with a central lead wire guiding mouth 26 which communicates with slots 28 and 30, formed in the plates 16 and 18, respectively, the walls of the slots 28 and 30 converging in a direction away from the mouth 26, towards parallel-sided wire gripping slot portions 31 and 33, respectively, in which the slots terminate, the portion 33 of the slot 30 being substantially narrower than the portion 31 of the slot 28. The plate 20 is unslotted and has a wire severing edge 21 extending across the lower (as seen in the Figures) part of the slot portion 33.

Figure 1:
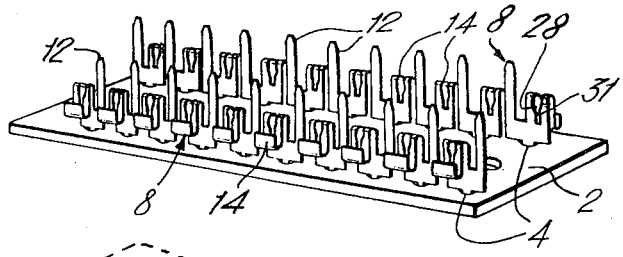
FIG. 1 is a perspective view of an electrical terminal assembly for the connection of electrical circuit components to external leads and for supporting the components on a panel.

The terminal 8 may be assembled to the panel 2 by means of a conventional staking machine (not shown), the insertion of the terminals into the holes 4 being limited by the abutment of shoulders 36 on the plates 10 against the panel 2. As shown in FIG. 1, the holes 4 are arranged in two parallel rows, the terminals of one row being arranged in back-to-back relationship with those of the other two, that is to say the plates 16 of one row face the plates 16 of the other row. The holes of each row are equidistant, the spacing between the holes of the two rows being equal. Since the terminals 8 of one row are disposed in back-to-back relationship with respect to those of the other row, the rows are longitudinally offset from one another in such a way that the slots of the member 14 of each terminal of one row are at least substantially aligned with the slots of the member 14 of a terminal of the other row.

Figure 2:
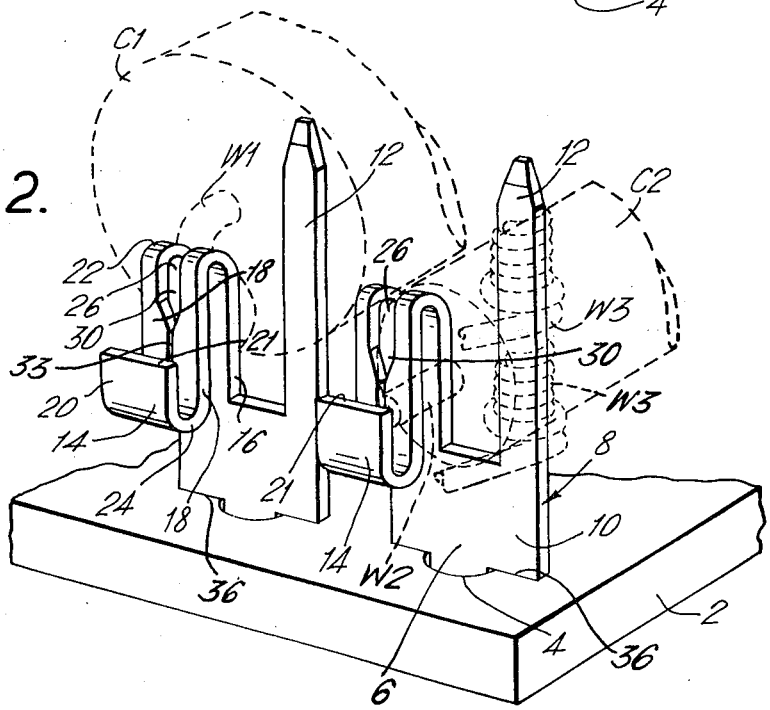
FIG. 2 is an enlarged perspective view of part of the assembly of FIG. 1, showing the manner in which the components are supported on the panel and connected to the leads.

As shown in FIG. 2, the assembly can be used for mounting electrical circuit components, for example resistors or capacitors, C1 and C2, having bare lead wires W1 and W2; respectively, of different gauges. Only one lead wire of each component is shown. To mount these components in the assembly, a lead wire of each component is inserted through the mouth 26 of each of two opposite members 14 of the two rows, in a direction perpendicular to the length of the lead wire. Each lead wire is then pressed down into the slots of the appropriate member 14, by means of a tool (not shown) which may be a tool as described in the specification. of our U.S. Pat. No. 3,628,202, so that the lead wire is forced into the portions 31 and 33 of the slots. The tool has a wire severing blade (not shown) which cooperates with the edge 21 of the plate 20 to shear off the excess length of the lead wire.

As shown in FIG. 2, the lead wire W1 has been cranked, in view of the large diameter of the component C1, to allow the insertion of the wires W1 into the appropriate slots. Since the wire-gripping portion 33 of the slot of the plate 18 of each terminal 8 is of smaller width than the wire-gripping portion 31 of the slot of the plate 16 of the terminal, each terminal can be used to accomodate lead wires of various different gauges. The larger gauge lead wire W1 is gripped in electrically conductive fashion between the walls of the slot portion 31 of the plate 16 but is partially sheared by the walls of the slot portion 33 of the plate 18, whereas a smaller diameter lead wire W2 is effectively gripped between the walls of the slot portion 33 of the plate 18 but fits only loosely in the slot portion 31 of the plate 16. There is accordingly no danger of the wire W1 being partially sheared through to such an extent as to impair the support of the component C1.

The posts 12 serve, as shown in FIG. 2 (right-hand side) for connection of external leads W3 to the electrical components. It will be apparent from FIG. 2 that the leads W3 have been applied to the post 12 by means of a wire wrapping tool, which is not shown. However, the leads W3 could be applied to the posts by other means, for example by securing the leads to the posts by means of electrical clips. Also, the posts 12 may be replaced by lead connecting means other than posts, for example tabs for mating with electrical receptacles, solder tags, or crimping ferrules. The base 10 itself may serve as lead connecting means, in which case a lead W3 is simply soldered to the base 10. Further, the lug 6 may serve as a lead connecting means, being soldered to a printed or other conductor on the panel 2.

I claim:

1. An electrical terminal comprising a base in the form of a flat plate, a lug projecting from one edge of the plate, an external lead connecting post projecting from the opposite edge of the plate and an electrical component supporting and connecting member also projecting from the opposite edge of the plate, the connecting member comprising a pair of parallel plates connected by a bight of the terminal material, the bight having a lead wire guiding mouth communicating with a lead wire receiving slot in each of the parallel plates, the slot of one of the parallel plates being narrower than the slot of the other parallel plate, the other parallel plate being directly connected to the opposite edge of the base plate and being coplanar therewith, the post being coplanar with the other parallel plate, the one parallel plate being connected by a bight to a wire severing plate parallel thereto and having a wire severing edge extending across the slot of the one parallel plate.

* * * * *